US005257824A

United States Patent [19]

Eggen

[11] Patent Number: 5,257,824

[45] Date of Patent: Nov. 2, 1993

[54] EXTENDER FOR A PLUMBING MOUNT WITH SPRING LOADED SEALING PISTON

[76] Inventor: Harald I. Eggen, 601 Railroad Ave., Round Lake, Ill. 60073

[21] Appl. No.: 814,500

[22] Filed: Dec. 30, 1991

[51] Int. Cl.[5] ..... F16L 17/00; F16L 41/00

[52] U.S. Cl. ..... 285/101; 137/359; 285/150; 4/695

[58] Field of Search ..... 285/100, 101, 130, 169, 285/176, 193, 150; 137/359, 801; 4/695, 696

[56] References Cited

U.S. PATENT DOCUMENTS

| | | | |
|---|---|---|---|
| 1,556,241 | 10/1925 | Mueller | 285/193 |
| 2,712,458 | 7/1955 | Lipson | 295/101 |
| 2,838,773 | 6/1958 | Muse . | |
| 2,871,810 | 2/1959 | Quitter . | |
| 2,872,810 | 2/1959 | Shaffer . | |
| 3,076,671 | 2/1963 | Freeman . | |
| 3,248,131 | 4/1966 | Mitton . | |
| 3,268,243 | 8/1966 | Word, Jr. . | |
| 3,292,952 | 12/1966 | Shapiro . | |
| 3,934,314 | 1/1976 | Whysall . | |
| 3,934,315 | 1/1976 | Millheiser et al. . | |
| 4,003,401 | 1/1977 | Häring . | |
| 4,054,157 | 10/1977 | Moseley, Jr. | 285/8 |
| 4,059,290 | 11/1977 | Ichimi . | |
| 4,090,029 | 5/1978 | Lundeberg . | |
| 4,099,748 | 7/1978 | Kavick . | |
| 4,502,165 | 3/1985 | Szemeredi | 137/359 |
| 4,553,560 | 11/1985 | Tucker et al. | 137/359 |
| 4,662,389 | 5/1987 | Igbal | 137/359 |
| 4,804,002 | 2/1990 | Sasa et al. . | |
| 4,852,192 | 8/1989 | Viegener | 4/695 |
| 4,964,657 | 10/1990 | Gonzales | 285/8 |
| 5,024,419 | 6/1991 | Mulvey | 285/8 |
| 5,025,825 | 6/1991 | Gayton | 137/801 |
| 5,050,246 | 9/1991 | Huntoon | 4/695 |

FOREIGN PATENT DOCUMENTS

| | | | |
|---|---|---|---|
| 1247613 | 7/1986 | U.S.S.R. | 285/101 |
| 2065468 | 7/1981 | United Kingdom | 4/696 |

*Primary Examiner*—Eric K. Nicholson

*Attorney, Agent, or Firm*—Mathew R. P. Perrone, Jr.

[57] ABSTRACT

A substantially, cylindircal plumbing extender is capable of being secured to a faucet at one end thereof and to the water source at the other thereof. With a sealed piston therein the plumbing extender can replace the faucet holddown nut. Various sizes of male threaded members in the side of the cylinder provide for attachment of various water requiring appliances.

8 Claims, 6 Drawing Sheets

EXTENDER FOR A PLUMBING MOUNT WITH SPRING LOADED SEALING PISTON

This invention relates to an extender for a plumbing mount, and more particularly to an extender for a plumbing mount for simplifying the hook up of a sink and appliances.

BACKGROUND OF THE INVENTION

Tight working positions on plumbing installations are among the greatest complications for a plumber This is especially true with the installation of a sink. The sink faucet is generally installed on a ledge behind the sink. Because the sink protrudes downwardly covering and protecting the rear ledge the plumber has difficult installation procedure and service procedure on the sink—and especially on the faucets located on the rear ledge or at the rear of the sink. If this installation of a sink can be simplified, the great advantages thus obtained are clear.

Since a waterline runs to the sink, it is also feasible to attach a number of other appliances requiring water therearound to the water supply for the sink. Typical of such appliances are an icemaker and a sprayer. The confining area of the sink complicates these installations also.

SUMMARY OF THE INVENTION

Therefore, among the many objectives of this invention is the objective of providing a plumbing extender to minimize the problem of cramped working conditions around a sink.

A further objective of this invention is to provide an appliance extender to simplify the attachment of an appliance to a water source.

A still further objective of this invention is to provide a plumbing extender to eliminate the use of a holddown nut.

Yet a further objective of this invention is to provide an appliance extender to simplify the attachment of more than one appliance to a water source.

Also an objective of this invention is to provide a plumbing extender to seal a faucet attachment.

Another objective of this invention is to provide a method to simplify the attachment of an appliance to a water source.

Still another objective of this invention is to provide a method to eliminate the use of a holddown nut.

Yet another objective of this invention is to provide a method to simplify the attachment of more than one appliance to a water source.

A further objective of this invention is to provide a method for sealingly attaching a faucet.

These and other objectives of this invention met by providing a substantially cylindrical appliance extender or a plumbing extender capable of being secured to a faucet at one end thereof and to a water source at the other thereof. With a sealed piston added into the plumbing extender, it is possible for the plumbing extender to additionally replace the faucet holddown nut. Various sizes of male threaded members in the side of the cylinder provide for attachment of various water requiring appliances.

Figure 1:
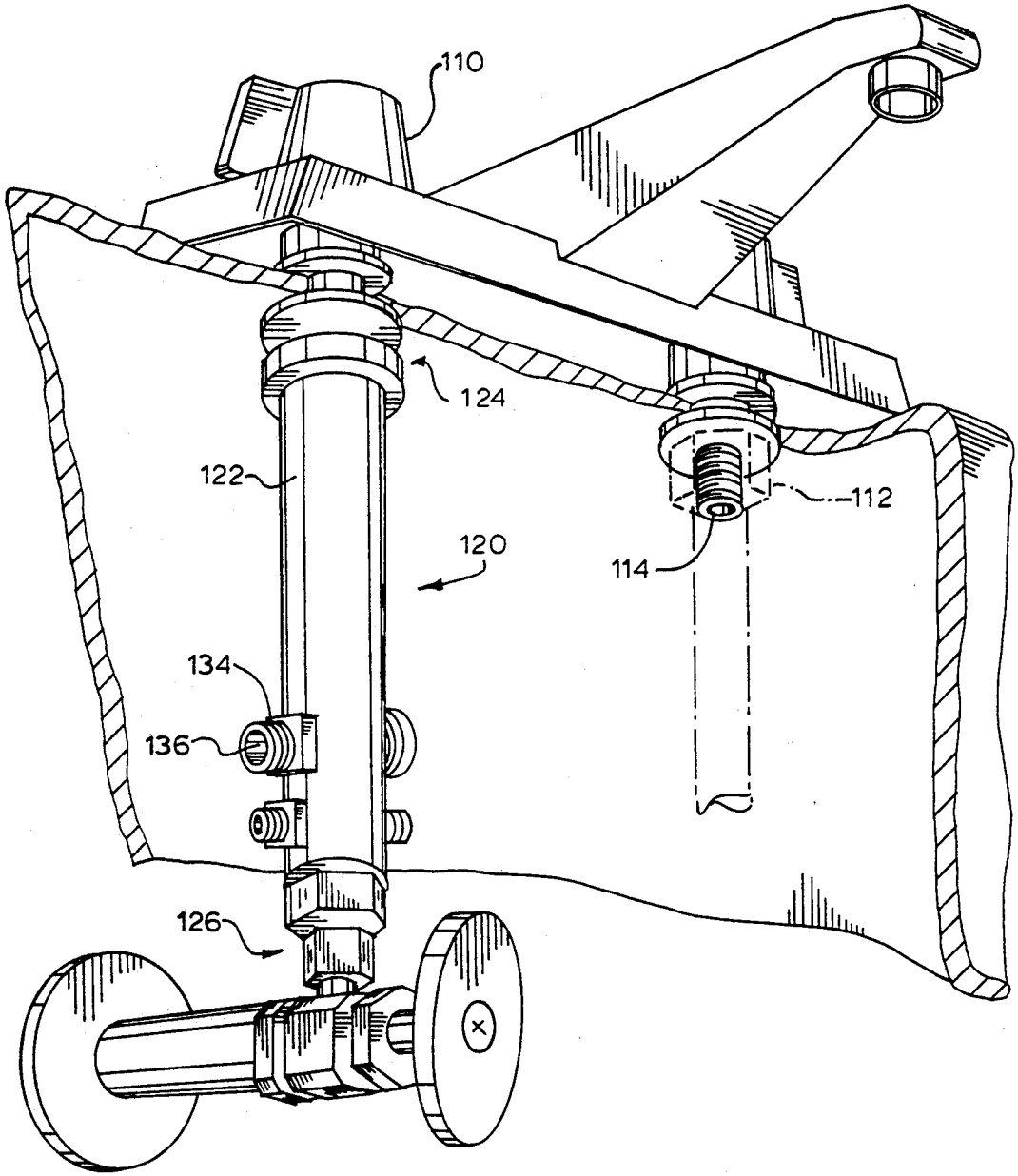
FIG. 1 depicts a perspective view of plumbing extender 120 attached to a sink 110.
Figure 2:
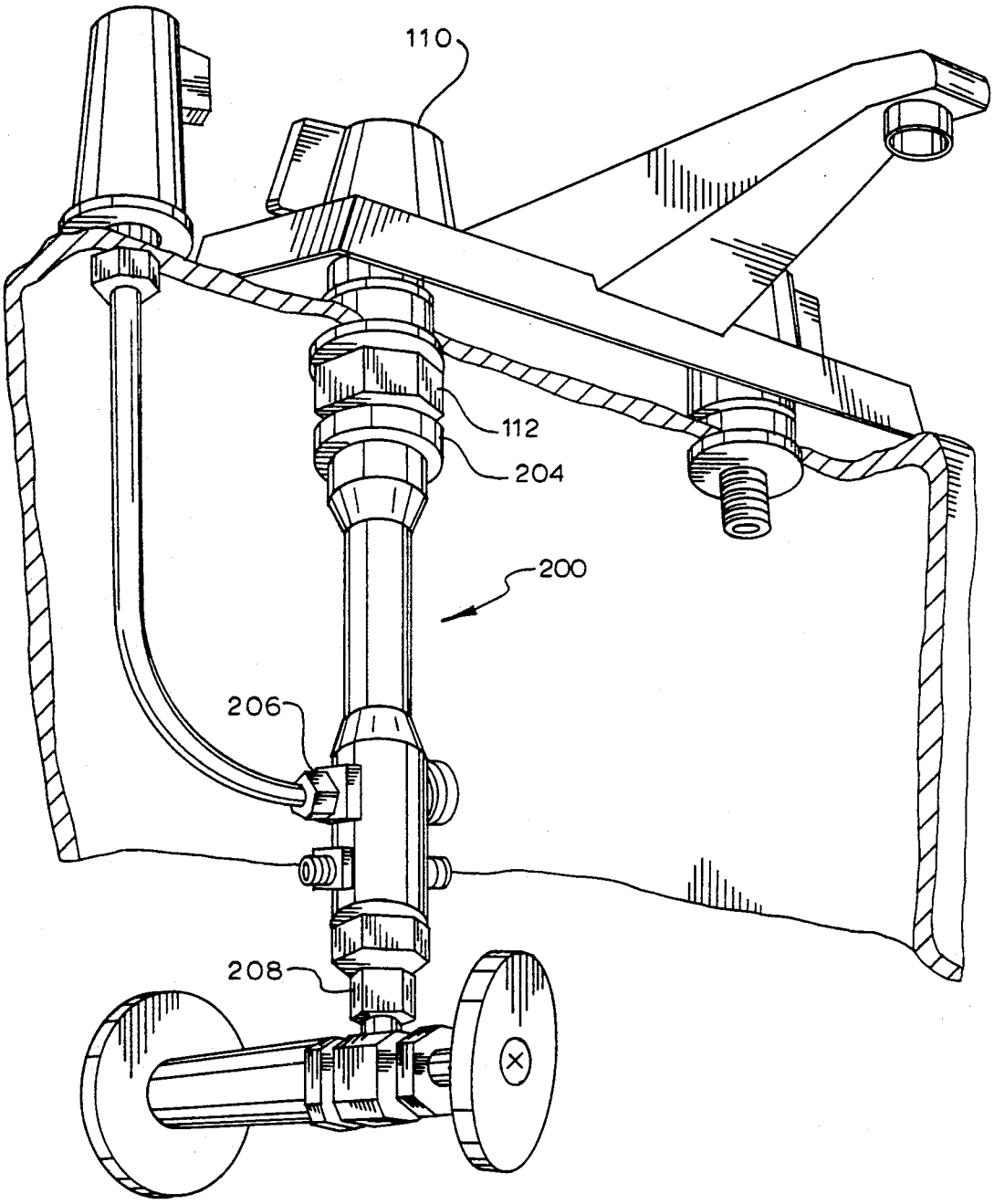
FIG. 2 depicts a perspective view of a appliance extender 200 attached to a sink 110.
Figure 3:
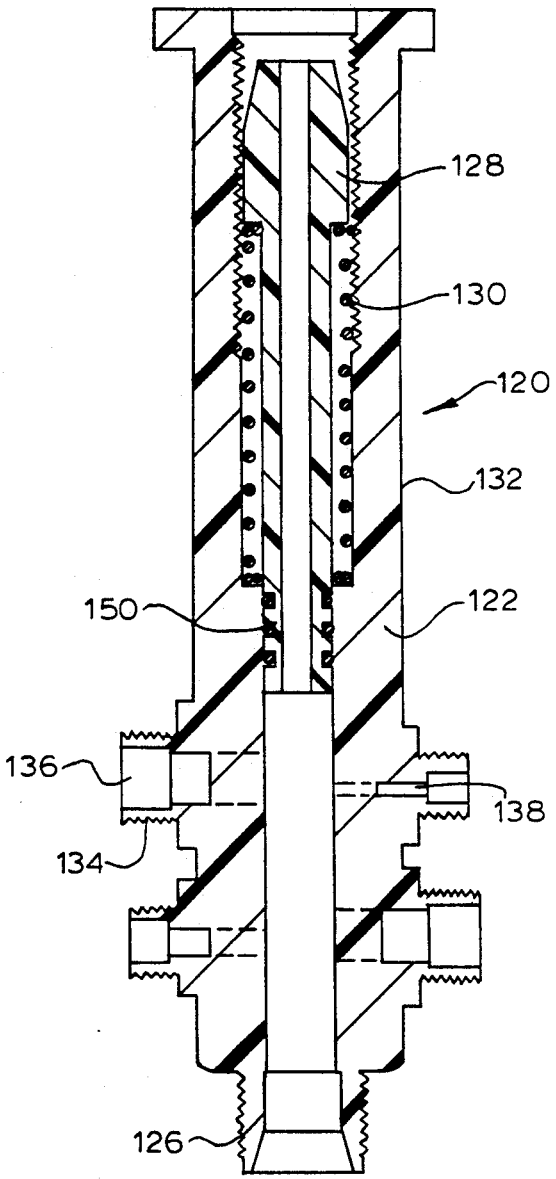
FIG. 3 depicts a cross-sectional view of extender 120 with piston 128 utilizing O-rings 150.
Figure 4:
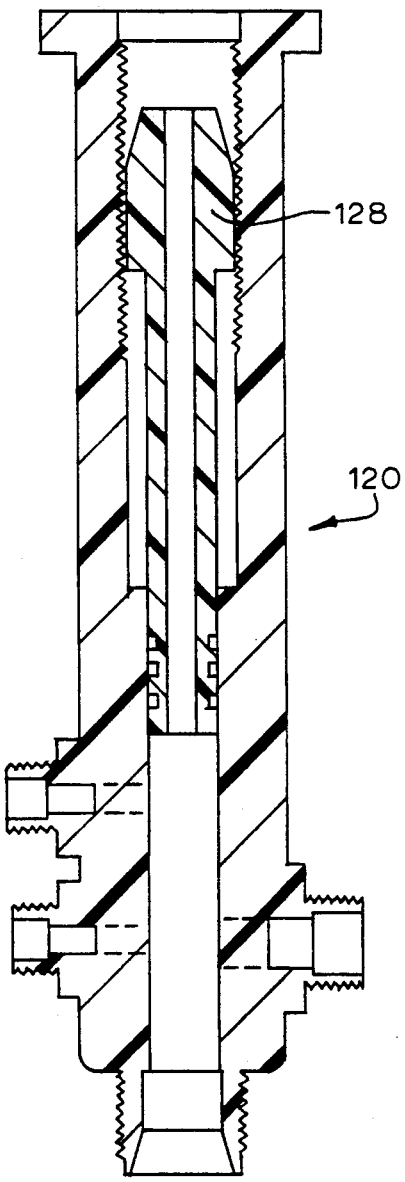
FIG. 4 depicts a cross-sectional view of extender 120 utilizing a spring 130.
Figure 5:
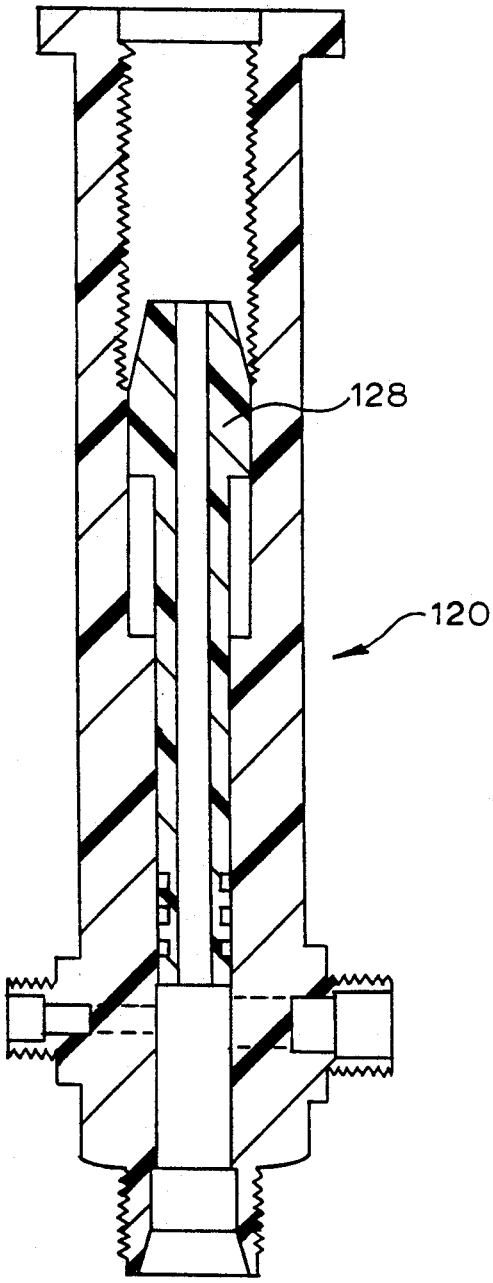
FIG. 5 depicts a cross-sectional view of showing a different position or the piston 128 inside plumbing extender 120.
Figure 6:
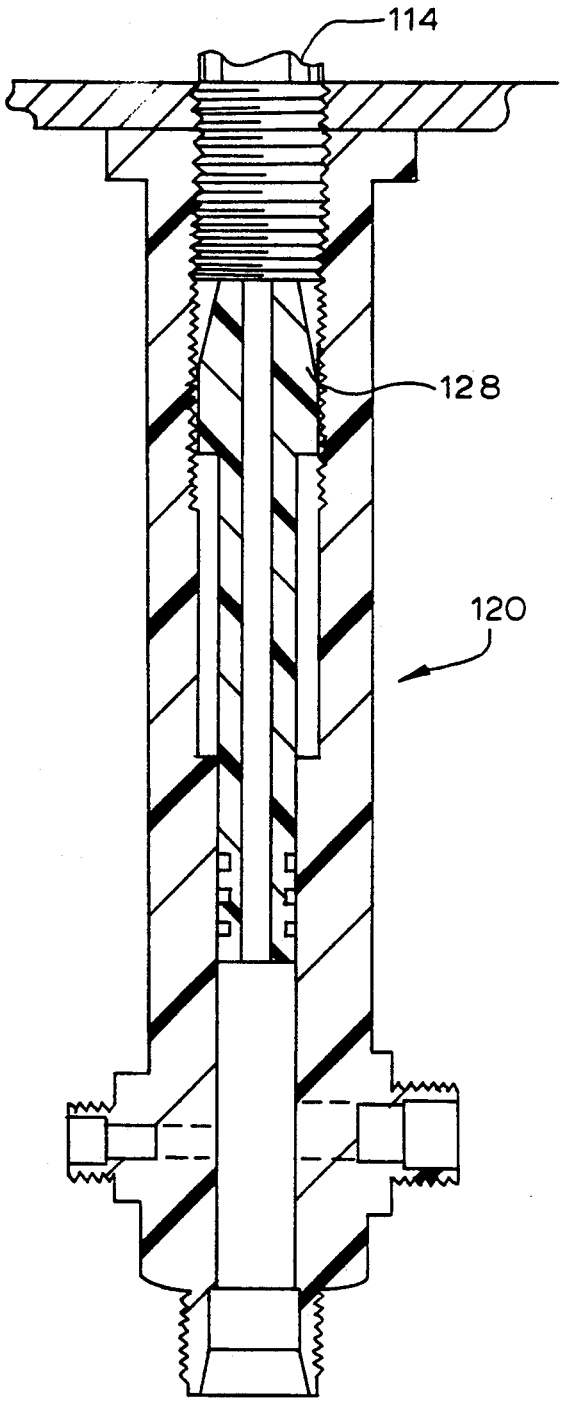
FIG. 6 depicts a cross-sectional view showing plumbing extender 120 installed with piston 128 in position.
Figure 7:
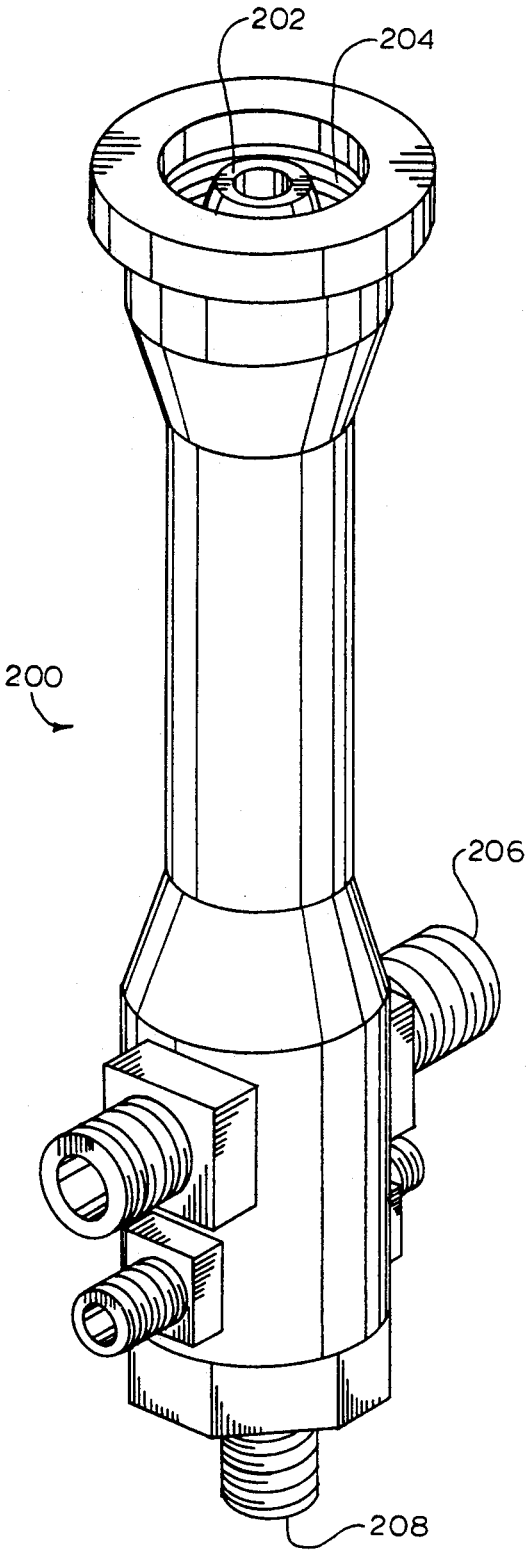
FIG. 7 depicts a perspective view of appliance attachment 200.
Figure 8:
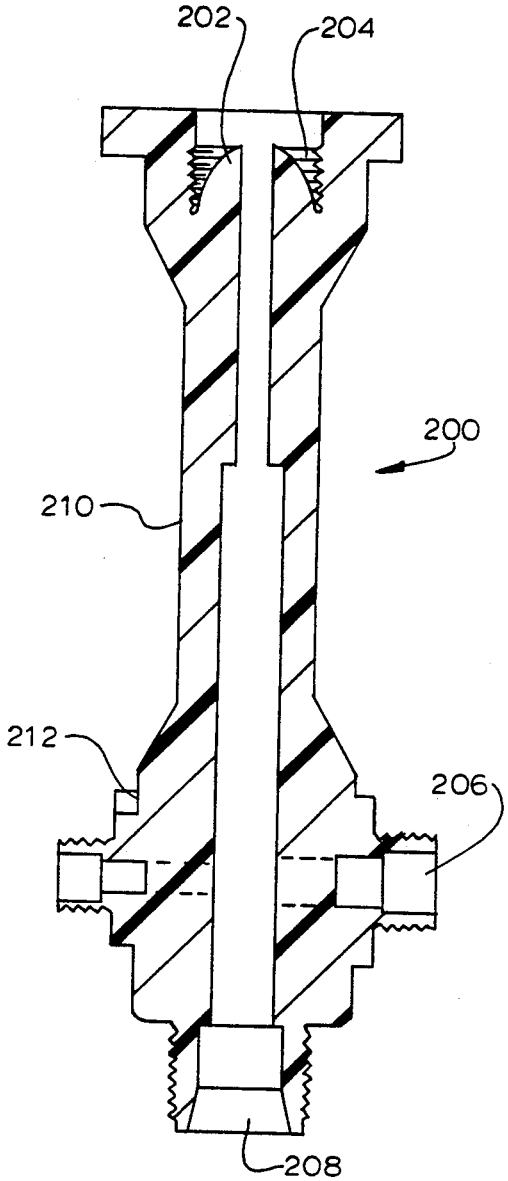
FIG. 8 depicts a cross-sectional view of appliance attachment 200.

9 depicts a plurality of appliance attachment 200 secured together in a three dimensional form.

Throughout the figures of the drawings, where the same part appears in more than one figure of the drawings, the same number is applied thereto.

DESCRIPTION OF THE PREFERRED EMBODIMENTS

A plumbing extender of this invention simplifies the installation of a sink—especially to the water source. An appliance extender of this invention simplifies the installation of an appliance which requires water.

The plumbing extender includes a tubular member having a spring loaded, O-ring sealed piston at one end capable of joining with a faucet in a simple fashion. The spring loaded O-ring piston permits the extender to be snapped or threadably secured into place on the faucet—with or without a tool. The sealing mechanism in the form of the piston with or without using the interior spring loaded mount simplifies the installation.

Once this device is secured in place it is possible to further connect the faucet to the desired point. In this fashion, plumbing is greatly simplified. The mounting bracket inside the cylinder is optionally spring loaded with the spring and a gripping housing for the purposes of tightly and water tightly sealing the faucet mount. In this fashion, with the snap on aspects of this device, an extension and simplified faucet mount is achieved.

The plumbing extender with the spring loaded O-ring sealed piston at one end can avoid the use of a nut to lock the faucet in place. Various outlets can be provided on the plumbing extender in order to provide access to water for various other appliances as does appliance extender. Typical of this access is for a dishwasher, an ice maker, a sprayer or similar devices. This access provides for simplicity of attachment and greatly facilitates attaching of these devices.

The appliance extender provides an extension from the faucet and holddown nut therefor, and permits greater access for the attachment of an additional appliance. When in used in combination with the lock nut, the device can eliminate the spring loaded O-ring seal. With the nut and the attachment of the appliance extender, the sealing takes place. Outlets similar to those on the plumbing extender are on the appliance extender. These outlets have the similar function of providing for attachment of the other implements or appliances. At the same time, easy attachment to the water line is provided. In this fashion, the desired results can be obtained.

Both the plumbing extender and the appliance extender may be rotated up to four hundred fifty (450° ) degrees after sealing is achieved. In this fashion the various outlets may be positioned as desired for the attachment of other devices, while still maintaining the desired seal.

Each outlet has a male threaded member situated thereover. Each threaded member is a different size for a different attachment. Each outlet is closed and openable as desired. The preferred structure is that the outlet be molded as closed with a guide molded therein to direct a drill thereto and open the outlet. Another device, such as a removable plug may also be used.

With rotation characteristics of the plumbing extender and the appliance extender, a plurality thereof may be used to simplify complicated connections. Three or more devices may even create a three dimensional shape—such that the cylindrical axis of one extender is not coplanar with one or more of the other cylindrical axes.

Referring now to FIG. 1, FIG. 3, FIG. 4, FIG. 5 and FIG. 6, plumbing extender 120 is basically cylindrical or tubular in nature. It has a open tubular portion 122 centrally located therein, with a female threaded insert 124 at a top portion thereof and a male threaded member 126 at the bottom portion thereof. The open tubular portion 122 receives the main flow of water. n tubular portion 122 centrally located therein, with a female threaded insert 124 at a top portion thereof and a male threaded member 126 at the bottom portion thereof. The open tubular portion 122 receives the main flow of water.

A piston 128 is slidably mounted therein and sealably engaged therewith by a plurality of O-rings 150. The spring 130 is optional and may additionally support the piston 128. The piston 128 permits sealing of the plumbing extender 120 to a faucet 110 and holding of the faucet 110 without a lock nut 112. In this fashion, the central axis of the open tubular portion 122 and the hollow piston 128 coincide to achieve the desired water flow therethrough.

This particular plumbing extender 120 in view of the piston 128 action can replace a lock nut 112 used for a faucet 110. In this fashion, installation of faucet 110 is greatly simplified. On the exterior wall 132 of the open tubular portion 122 adjacent to the male threaded member 126 at the bottom portion are additional male threaded ends 134 of various sizes for connection to various appliances. Molded or otherwise shaped in male threaded member 126 is a drill guide 138 suitable opening the same efficiently with a drill. As a suitable appropriate size for one of the male threaded ends 134 is such that it may be used to attach an ice maker.

Within each of the male threaded ends 134 can be a plug 136 or another solid member, which may be drilled or punched out depending on which of male threaded ends 134 it is desired to use. In this fashion, an ice maker or other suitable appliance may be attached thereto and be provided with water thereby.

Considering now FIG. 1, FIG. 2, FIG. 7, and FIG. 8, appliance extender 200 has the sealing mechanism 202 molded therein adjacent the female threaded end 204 and can seal directly to the faucet pipe 114. However, appliance extender 200 requires the lock nut 112 for holding the faucet 110 in place. There are side male threaded members 206 adjacent to the male threaded end 208 to achieve the desired holding of the appliance water line.

Side male threaded members 206 are similar to male threaded ends 134. Both of these attachment features are highly useful and can molded or otherwise shaped thereon during the molding of the entire piece. It also becomes clear that there may be other attachments molded thereon, instead of or in addition to side male threaded members 206 and male threaded ends 134.

The sealing mechanism 202 molded therein adjacent the female threaded end 204 is tapered to receive a male threaded member such as that on faucet 110 in a sealing relationship. Appliance extender 200 also has open tubular portion 122, but lacks piston 128. The sealing mechanism 202 effectively replaces piston 128, from sealing aspect.

Each side male threaded member 206 is a different size for a different attachment. Each side male threaded member 206 is a different size for a different attachment. An outlet 220 leads into open tubular portion 122. The outlet 220 is manufuactured as closed and openable as desired. The preferred structure is that the outlet 220 be molded as closed with a guide 222 molded therein to direct a drill or other cutting device thereto and open the outlet 220. Another device, such as a removable plug may also be used.

The plumbing extender 120 and the appliance extender 200 may be injected molded to be simply formed and provide for the efficient displacement of this water structure. Any suitable shape for the exterior cylinder is appropriate. The appliance extender 200 shows a narrow cylinder portion 210 with a broadened cylinder base 212 having the side male threaded members 206 on the exterior portion thereof. Accordingly, simple installation is possible. The female threaded end 204 is also exteriorly enlarged.

Figure 9:
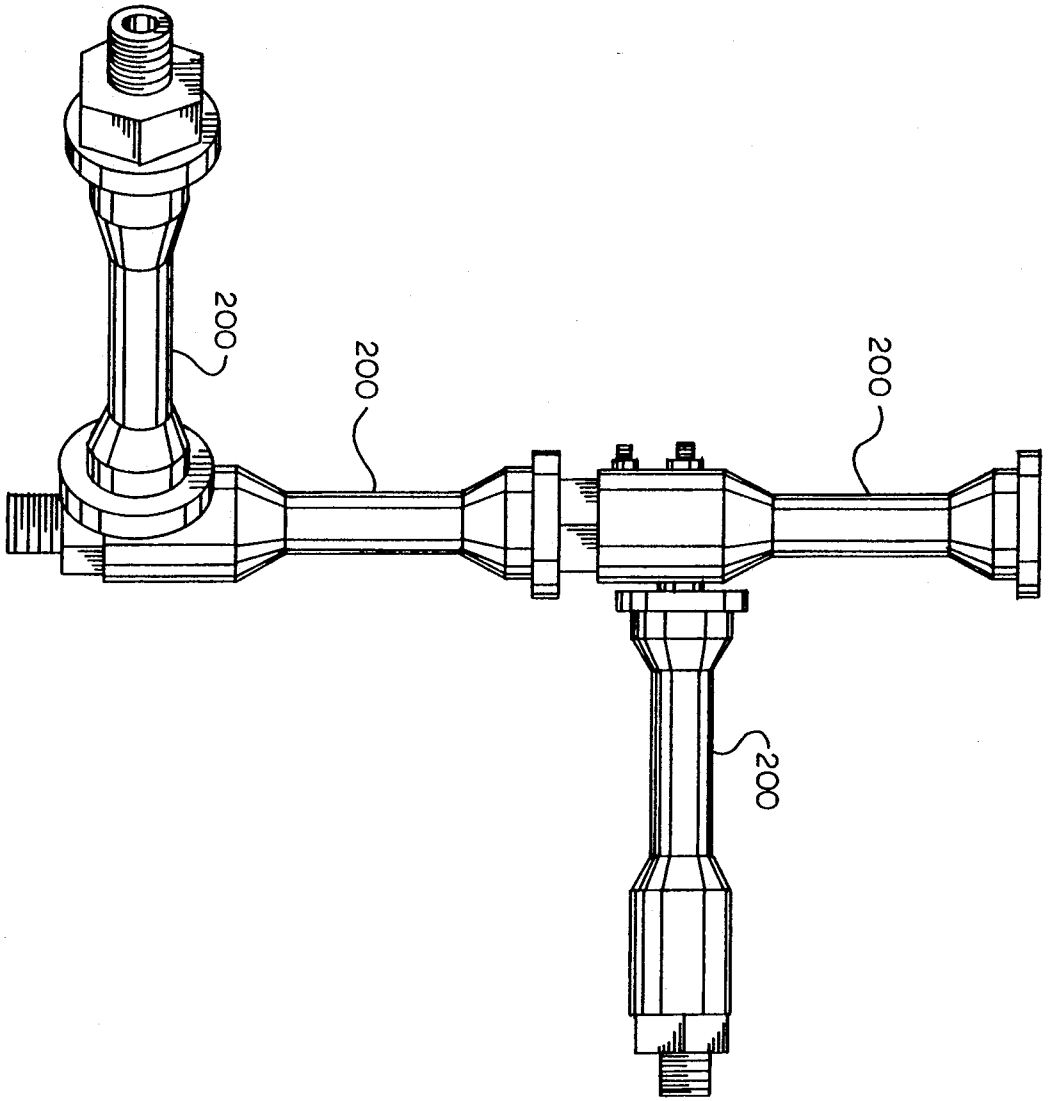

As can be seen in FIG. 9, both the plumbing extender 120 and the appliance extender 200 may be rotated up to four hundred fifty (450° ) degrees after sealing is achieved. They may even be used jointly or severally on the main water line of a building. In this fashion the various outlets may be positioned as desired for the attachment of other devices, while still maintaining the desired seal.

With rotation characteristics of the plumbing extender 120 and the appliance extender 200, a plurality thereof may be used to simplify complicated connections. Three or more devices may even create a three dimensional shape. The female threaded end 204 may receive one of the side male threaded members 206 to achieve this three dimensional shape. The additional male threaded ends 134 of the plumbing extender 120 may serve a similar function.

This application—taken as a whole with the specification, claims, abstract, and drawings—provides sufficient information for a person having ordinary skill in the art to practice the invention disclosed and claimed herein. Any measures necessary to practice this invention are well within the skill of a person having ordinary skill in this art after that person has made a careful study of this disclosure.

Because of this disclosure and solely because of this disclosure, modification of this method and apparatus can become clear to a person having ordinary skill in this particular art. Such modifications are clearly covered by this disclosure.

What is claimed and sought to be protected by Letters Patent of the United States is:

1. A plumbing extender for use with a water source wherein:

a) said plumbing extender includes a water source securing means;

b) said plumbing extender includes a faucet securing means;

c) said plumbing extender includes an elongated housing having a first housing end and a second housing end;

d) said faucet securing means is situated at said first housing end;

e) said water source securing means is situated at said second housing end;

f) said plumbing extender includes a piston slidably mounted within said elongated housing;

g) said piston provides a water-tight seal within said housing for said plumbing extender;

h) said plumbing extender includes at least one means for providing water to an appliance;

i) said elongated housing has a hollow cylindrical shape with a central cylindrical axis;

j) said faucet securing means has a faucet means axis coaxial with said central cylindrical axis;

k) said water source securing means has a water source axis coaxial with said central cylindrical axis;

l) said means for providing water to an appliance has a water axis;

m) said water axis and said central cylindrical axis intersect at an angle;

n) said piston includes a tapered end;

o) said tapered end is adjacent to said faucet securing means;

p) said piston includes an O-ring end;

q) said O-ring end is oppositely disposed from said tapered end;

r) said O-ring end includes at least one O-ring mount thereon;

s) said plumbing extender includes a spring mounted within said elongated housing; and t) said spring supports said piston.

2. The plumbing extender of claim 1 wherein said means for providing water to an appliance includes a male threaded attachment means.

3. An appliance extender for use with a water source wherein:

a) said appliance extends includes a water source securing means;

b) said appliance extender includes a faucet attaching means;

c) said appliance extender includes an elongated housing having a first housing end and a second housing end;

d) said faucet attaching means is situated at said first housing end;

e) said water source securing means is situated at said second housing end;

f) said appliance extender includes a tapered piston slidably mounted within said elongated housing; and g) said tapered piston provides a water-tight seal for said appliances extender;

h) said plumbing extender includes a spring mounted within said elongated housing; and i) said spring supports said piston.

4. The appliance extender of claim 3 wherein:

a) said appliance extender includes at least one means for providing water to an appliance;

b) said elongated housing has a hollow cylindrical shape with a central cylindrical axis;

c) said faucet attaching means has a faucet means axis coaxial with said central cylindrical axis;

d) said water source securing means has a water source axis coaxial with said central cylindrical axis;

e) said means for providing water to an appliance includes a water axis; and f) said means axis and said central cylindrical axis intersect at an angle.

5. The appliance extender of claim 4 wherein said appliance extender is used in combination with a nut to secure said faucet.

6. The plumbing extender of claim 5 wherein said means for providing water to an appliance includes a male threaded attachment means.

7. The appliance extender of claim 6 wherein said appliance extender is attached to at least one other of said appliance extender.

8. The appliance extender of claim 7 wherein said appliance extender is attached to a plumbing extender.

* * * * *